US011911649B2

(12) United States Patent
Hull

(10) Patent No.: US 11,911,649 B2
(45) **Date of Patent: *Feb. 27, 2024**

(54) EXERCISE DEVICE CONFIGURED FOR ATTACHMENT TO A DESK, TABLE, COUNTERTOP OR SIMILAR ARTICLE

(71) Applicant: Kory Hull, Ladera Ranch, CA (US)

(72) Inventor: Kory Hull, Ladera Ranch, CA (US)

( * ) Notice: Subject to any disclaimer, the term of this patent is extended or adjusted under 35 U.S.C. 154(b) by 73 days.

This patent is subject to a terminal disclaimer.

(21) Appl. No.: 17/305,941

(22) Filed: Jul. 16, 2021

(65) Prior Publication Data

US 2021/0339074 A1 Nov. 4, 2021

Related U.S. Application Data

(63) Continuation-in-part of application No. 17/026,122, filed on Sep. 18, 2020, now Pat. No. 11,266,869.

(Continued)

(51) Int. Cl.
*A63B 21/16* (2006.01)
*A63B 21/00* (2006.01)

(Continued)

(52) U.S. Cl.
CPC ..... *A63B 21/16* (2013.01); *A63B 21/0414* (2013.01); *A63B 21/0557* (2013.01); *A63B 21/4035* (2015.10)

(58) Field of Classification Search
CPC ..... A63B 21/0442; A63B 21/4035; A63B 2225/09; A63B 2208/0233;

(Continued)

(56) References Cited

U.S. PATENT DOCUMENTS 1,371,073 A * 3/1921 Crandall ..... B25B 5/003 269/268
3,815,904 A * 6/1974 Weiss ..... A63B 21/0004 482/123

(Continued)

OTHER PUBLICATIONS

Work-N-Stretch Document (derived from: Work-N-Stretch, Web Archive capture date Aug. 17, 2019 [retrieved Dec. 1, 2021], Retrieved from: https://web.archive.org/web/20190817093206/http://worknstretch.com/) (Year: 2019).*

(Continued)

*Primary Examiner* — Joshua Lee
*Assistant Examiner* — Catrina A Letterman
(74) *Attorney, Agent, or Firm* — FisherBroyles, LLP; Rob L. Phillips

(57) ABSTRACT

An exercise unit includes a pair of brackets configured to attach to a desktop in a spaced manner, a first set of resistance bands extend from a handle to the two spaced brackets in a horizontal orientation with the handle near a mid-point thereof. When attached to the desktop, the brackets maintain the resistance bands and handle generally underneath the desktop when not in use. When needed, the user grips the handle with two hands and performs various exercises while seated in his or her chair. The handle is configured ergonomically to match the angle of the user's hands when gripping the handle from a seated position. As second set of resistance bands with handles at one end thereof may be attached to the brackets to perform additional exercises.

5 Claims, 24 Drawing Sheets

Related U.S. Application Data

(60) Provisional application No. 62/903,510, filed on Sep. 20, 2019.

(51) Int. Cl.
*A63B 21/055* (2006.01)
*A63B 21/04* (2006.01)

(58) Field of Classification Search
CPC ..... A63B 2210/00; A63B 21/16–169; A63B 21/4033; A63B 21/02; A63B 21/055–0557; A63B 21/028; A63B 21/04–0414; B25B 5/00–166
See application file for complete search history.

(56) References Cited

U.S. PATENT DOCUMENTS 5,505,681 A * 4/1996 Bruggemann ..... A63B 21/153 482/904
5,643,149 A * 7/1997 Grimaldi ..... A63B 5/20 482/122
5,842,956 A * 12/1998 Strachan ..... A63B 5/20 482/81
7,178,777 B1 * 2/2007 Banker ..... B25H 3/006 248/316.7
2007/0213186 A1 * 9/2007 Longo ..... A63B 21/0552 482/121
2007/0262506 A1 * 11/2007 Alberti ..... B25B 5/163 269/249
2010/0075818 A1 * 3/2010 Ebert ..... A63B 21/4035 482/124
2014/0128230 A1 * 5/2014 Burcham ..... A63B 21/0442 482/123
2014/0228180 A1 * 8/2014 Walker ..... A63B 21/0557 482/82
2017/0080273 A1 * 3/2017 Sanchez Gonzalez ..... A63B 23/0355
2019/0358780 A1 * 11/2019 MacDonald ..... B23K 37/0435

OTHER PUBLICATIONS

American DJ Document (derived from: American DJ, "American Dj Baby Clamp Light Duty Aluminum C Clamp" [online], Apr. 4, 2007 [retrieved on Dec. 1, 2021], Retrieved from: https://www.amazon.com/American-Baby-Clamp-Light-Aluminum/dp/B0006ZXF24/ref=asc_df_B0006ZXF24/?tag=hyprod-20&linkCode=df0&hvadid=312118595187&hvpos=&hvnetw=g&hvrand=10108740606011935775&hvpone=&hvptwo=&hvqmt=&hvdev=c&hvdvcmdl=&hvlocint=&hvlocphy=9028784&hvtargid=pla-570965831741&psc=1 (Year: 2007) (Year: 2007) (Year: 2007).*

* cited by examiner

EXERCISE DEVICE CONFIGURED FOR ATTACHMENT TO A DESK, TABLE, COUNTERTOP OR SIMILAR ARTICLE

CROSS-REFERENCE

This application is a continuation-in-part of, and claims priority to, U.S. patent application Ser. No. 17/026,122 filed Sep. 18, 2020, which claims priority to U.S. Patent Application No. 62/903,510 filed Sep. 19, 2019, both of which are incorporated herein for all purposes.

FIELD OF THE INVENTION

The embodiments of the present invention relate to an exercise device utilizing resistance bands and being attachable to a desk, table, countertop or similar article.

BACKGROUND

For those people working in offices or at desks, it can be challenging to find time to exercise. With the pandemic in full swing, the population of people sitting behind desks is ever increasing. Even a slight increase in heart rate can overcome the negative health consequences of a sedentary lifestyle.

It would be advantageous to develop an exercise device that may be attached to a desk, for example, and used while seated in the desk chair. Importantly, the exercise device, when not being used, should not interfere with use of the desk for conventional non-exercise activities.

SUMMARY

Accordingly, a first embodiment of the present invention comprises broadly a pair of brackets configured to attach to a desktop in a spaced manner, resistance bands configured to extend from a handle to said two spaced brackets wherein the handle is a near a mid-point thereof. When attached to the desktop, the brackets maintain the resistance bands and handle generally underneath the desktop when not in use. When needed, the user grips the handle with two hands and performs various exercises while seated in his or her chair.

In one embodiment, the brackets are configured to retain multiple resistance bands allowing the user to increase or decrease the resistance as needed. In another embodiment, the brackets are configured to provide increased stability against the force of the user pulling on the one or more resistance bands while exercising.

In another embodiment, one or more additional resistance bands and handles are removably attached to the brackets to provide unique exercise options over the resistance bands extending between the brackets.

Other variations, embodiments and features of the present invention will become evident from the following detailed description, drawings and claims.

DETAILED DESCRIPTION

Figure 1:
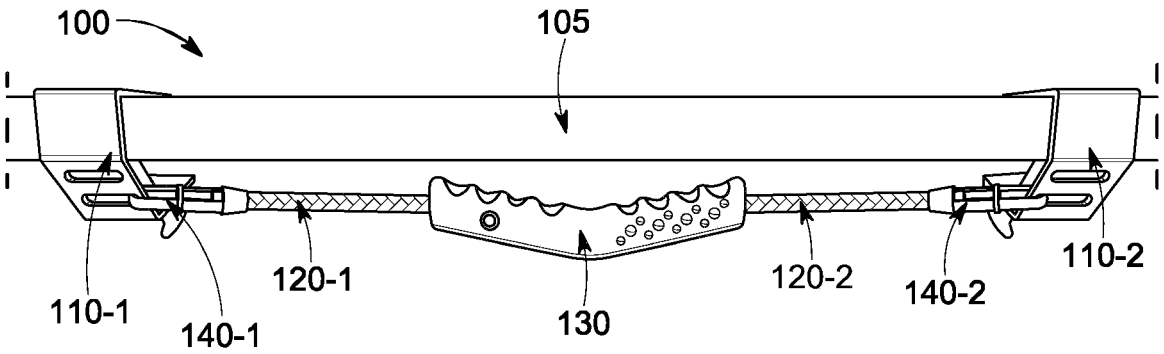
FIG. 1 illustrates an underside view of a desk with an exercise unit and one band secured thereto according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The brackets and handle of the present invention may be made using any suitable materials including, but not limited to, alloys, composites, metals, polymers, ceramics, plastics and combinations thereof. The resistance bands may be made using any suitable resilient materials including elastic, latex, rubber, fabric, etc. The components of the present invention may be fabricated using any suitable techniques including, but not limited to, milling, machining, molding, casting, 3D printing and combinations thereof.

Figure 2:
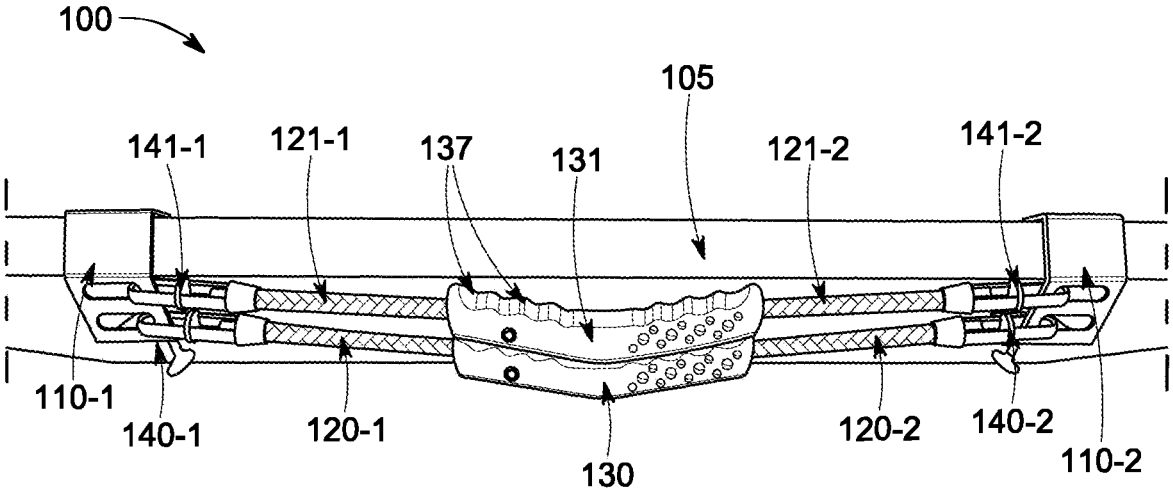
FIG. 2 illustrates an underside view of a desk with an exercise unit and two bands secured thereto according to the embodiments of the present invention.
Figure 3:
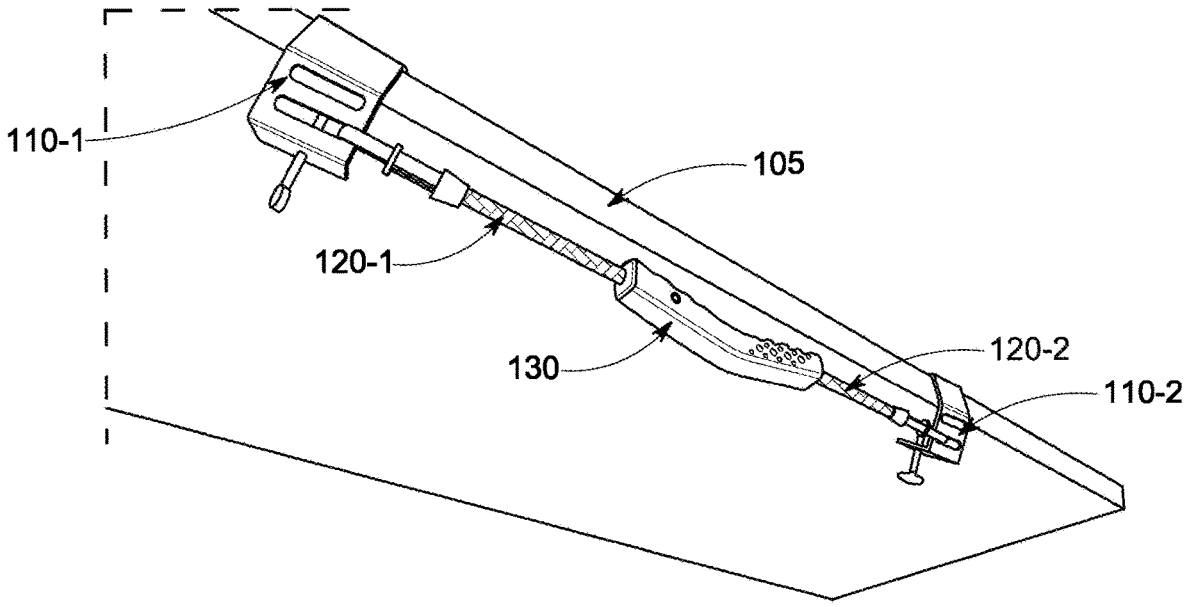
FIG. 3 illustrates another underside view of a desk with an exercise unit and one band secured thereto according to the embodiments of the present invention.
Figure 4:
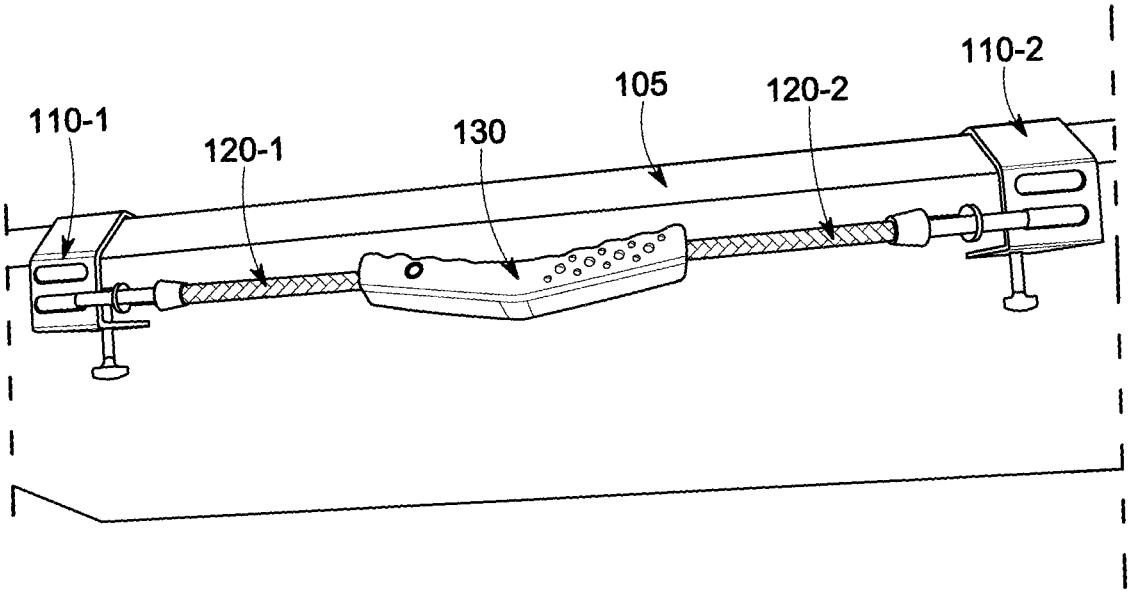
FIG. 4 illustrates another underside view of a desk with an exercise unit and one band secured thereto according to the embodiments of the present invention.

FIGS. 1-4 show an exercise unit 100 attached to a desktop 105. While a desk is discussed herein, any piece of furniture or article with a generally flat top and bottom with an exposed edge and sufficient space underneath may receive the exercise unit 100. The exercise unit 100 comprises a pair of brackets 110-1, 110-2, a first set of resistance bands 120-1, 120-2, handle 130 and clips 140-1, 140-2. FIG. 2 shows a second pair of resistance bands 121-1, 121-2, corresponding handle 131 and clips 141-1, 141-2. As shown, the brackets 110-1, 110-2 are configured to maintain the first set of resistance bands 120-1, 120-2 and corresponding handle 130 beneath the desktop 105. The brackets 110-1, 110-2 are further configured to maintain the first set of resistance bands 120-1, 120-2 and corresponding handle 130 near the undersurface of the desktop so that the exercise unit 100 does not interfere with the user while he or she is seated in his or her chair while working at the desk.

Figure 5:
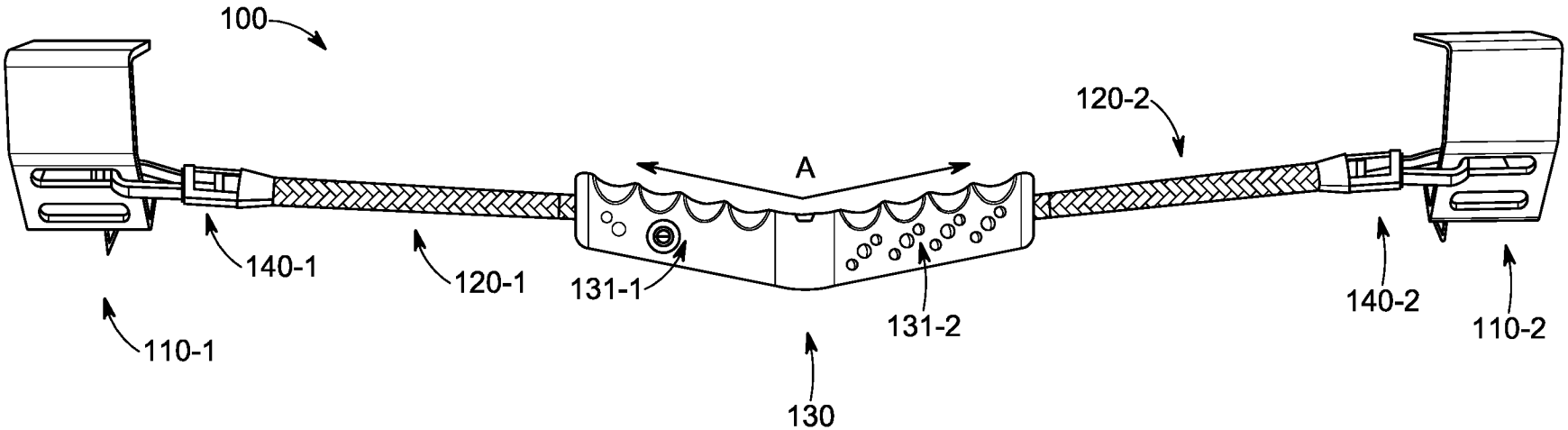
FIG. 5 illustrates a front view of the exercise unit according to the embodiments of the present invention.
Figure 6:
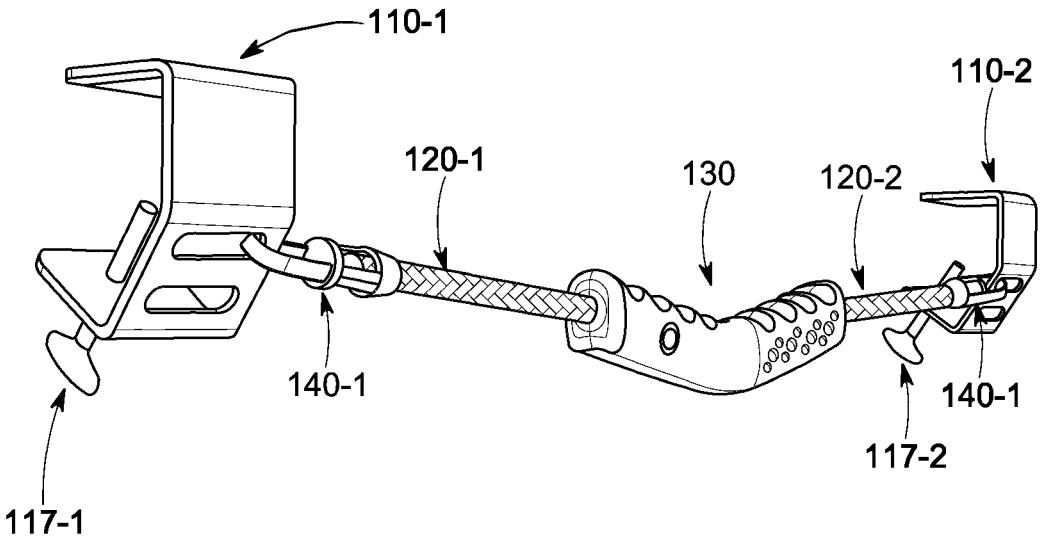
FIG. 6 illustrates a perspective front view of the exercise unit according to the embodiments of the present invention.

FIGS. 5 and 6 show the exercise unit 100 not attached to a desktop. As shown in FIGS. 1-6, in one embodiment, the handle 130 is ergonomically designed to accommodate a user's hands. Angle A, defined by a left-hand grip 131-1 and right-hand grip 132-1, creates a V-shape generally matching an angle of a user's hands when using the exercise unit 100 in a seated posture. A straight handle would not perform well as the user's hands would tend to slip off and become fatigued quickly during use.

FIG. 6 shows the brackets 110-1, 110-2 configured so that the threaded connectors 117-1, 117-2 (e.g., threaded bolts) used to attach the exercise unit 100 to the desk are angled against the direction of force that is applied when a user pulls on the first set of resistance bands 120-1, 120-2. In this manner, the bolts 117-1, 117-2 tend to more securely maintain the exercise unit 100 in position when attached to the desktop.

Figure 7:
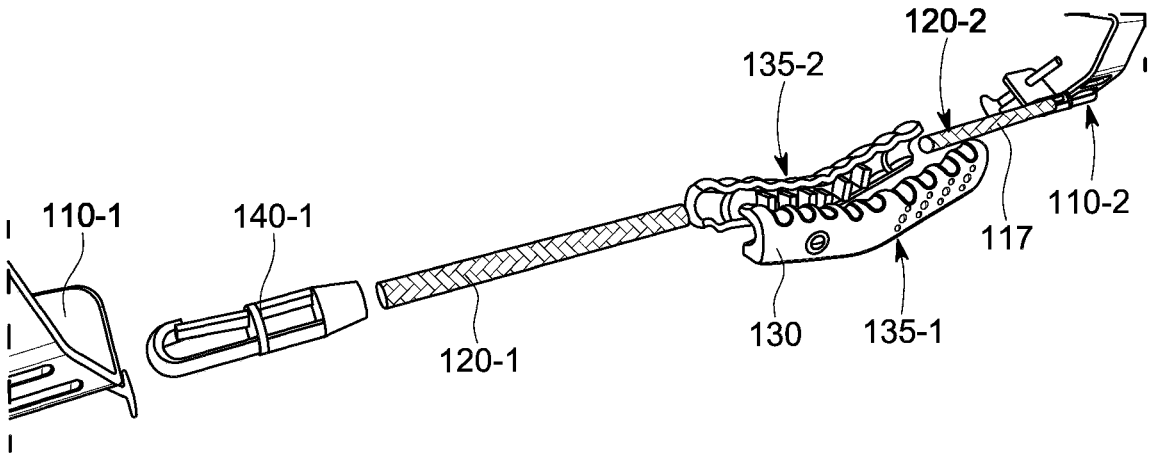
FIG. 7 illustrates an exploded view of the exercise unit according to the embodiments of the present invention.
Figure 8:
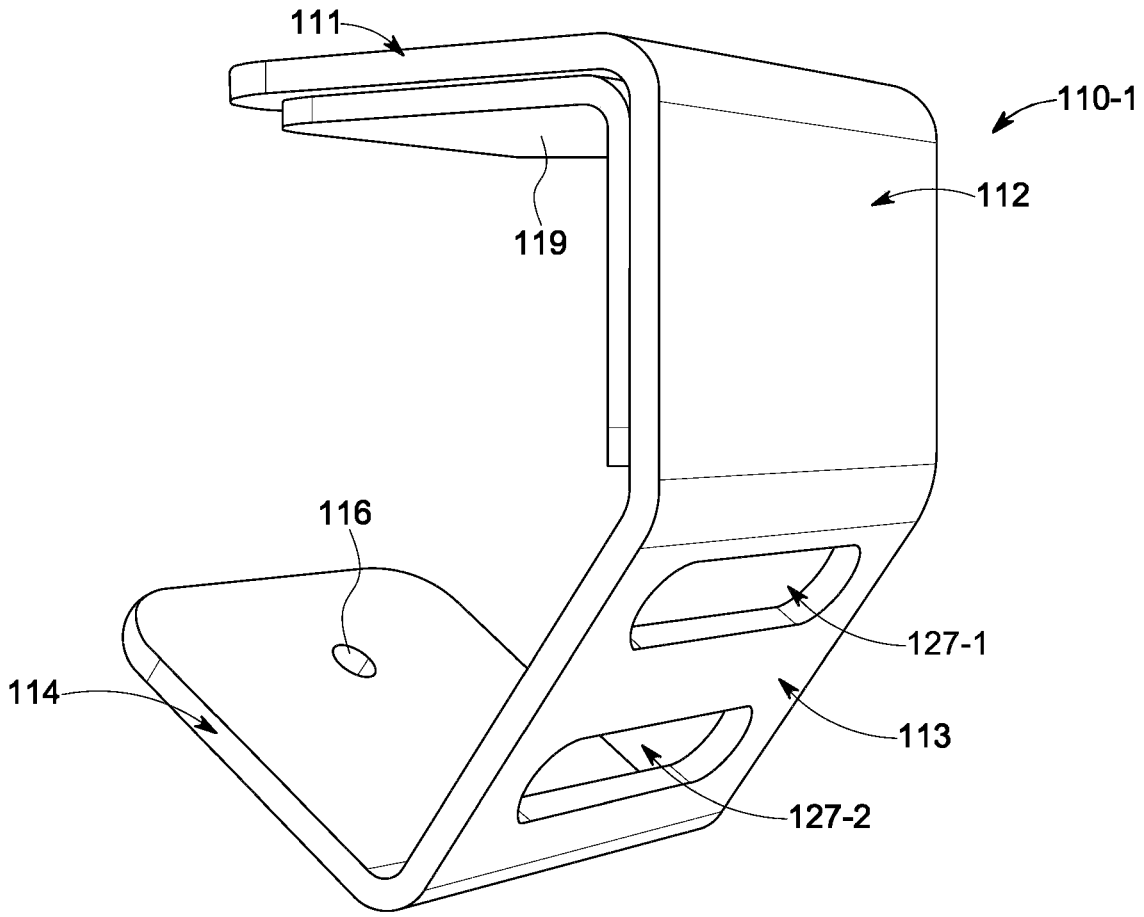
FIG. 8 illustrates a perspective front view of a bracket used to secure the exercise unit to a desk according to the embodiments of the present invention.
Figure 12:
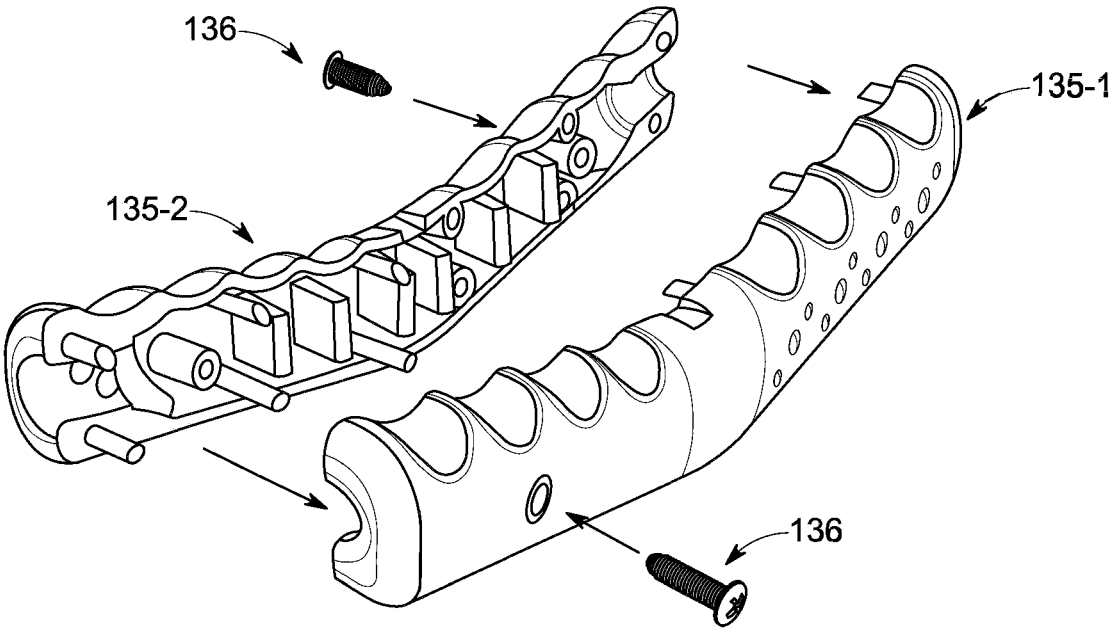
FIG. 12 illustrates an exploded view of a handle according to the embodiments of the present invention.
Figure 13:
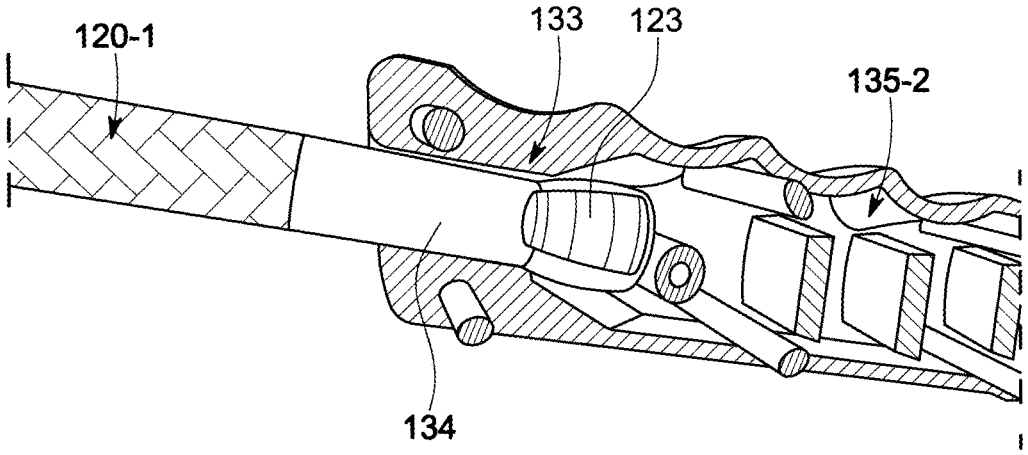
FIG. 13 illustrates a cut-away view of the resistance band attached to the handle according to the embodiments of the present invention.

FIG. 7 shows an exploded view of the exercise unit 100. Clips 140-1, 140-2 on the end of each resistance band 120-1, 120-2 serve to connect the first set of resistance bands 120-1, 120-2 to the brackets 110-1, 110-2 while second ends of the first set of resistance bands 120-1, 120-2 connect to the handle 130. As best seen in FIG. 8, the brackets 110-1, 110-2 include cut-outs 127-1, 127-2 for receiving clips 140-1, 140-2 of the first set of resistance bands 120-1, 120-2 and a second resistance band if desired. In an alternative arrangement, a single resistance band is used and extends completely through the handle 130. FIG. 12 shows a cut-away view of resistance band 120-1 connected to handle 130. A tube expansion plug 123 prevents resistance band 120-1 from dislodging from the handle 130 during use. In other words, the tube expansion plug 123 has a greater diameter than handle bore 133 so that the resistance band 120-2 remains connected to handle 130. A protective sleeve 134 or sheath prevents excessive wear and tear to the resistance band 120-1 that may be caused as the resistance band 120-1 stretches in the handle bore 133 during use. In one embodiment, the protective sleeve 134 is thermally attached to the resistance band 120-1.

Figure 11:
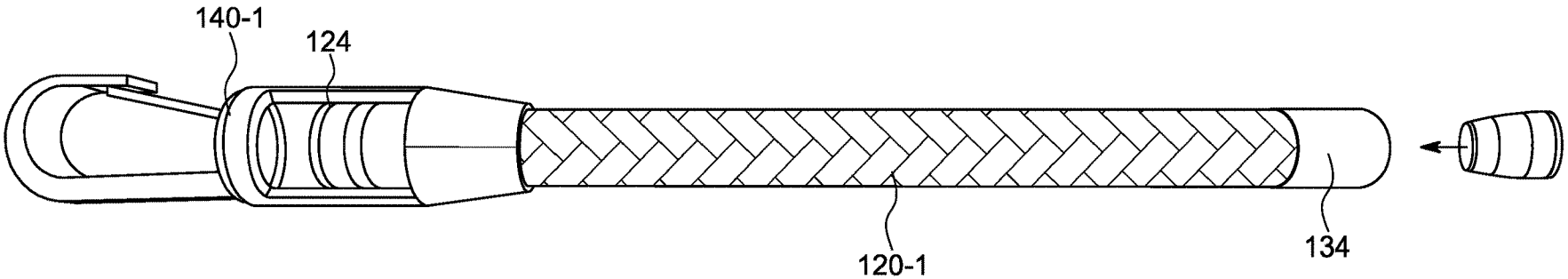
FIG. 11 illustrates a resistance band according to the embodiments of the present invention.

FIG. 11 shows a second tube expansion plug 124 maintaining the resistance band 120-1 connected to clip 140-1. While tube expansion plugs are detailed herein, those skilled in the art will recognize that other fasteners and mechanisms may be used to connect the first set of resistance bands 120-1, 120-2 to the handle 130 and clips 140-1, 140-2.

Now referring to FIG. 12, the handle 130, in one embodiment, comprises two symmetric members 135-1, 135-2 joined over the first set of resistance bands 120-1, 120-2 and tube expansion plugs 123. The two handle members 135-1, 135-2 may be connected using mechanical fasteners 136, adhesives, etc. Alternatively, the handle 130 may be molded as a single piece over the resistance bands (or single resistance band as disclosed above). The handle 130 includes 8 finger grooves 137 to ergonomically accommodate a user's fingers while the thumbs are wrapped side-by-side under the handle 130.

Figure 9A:
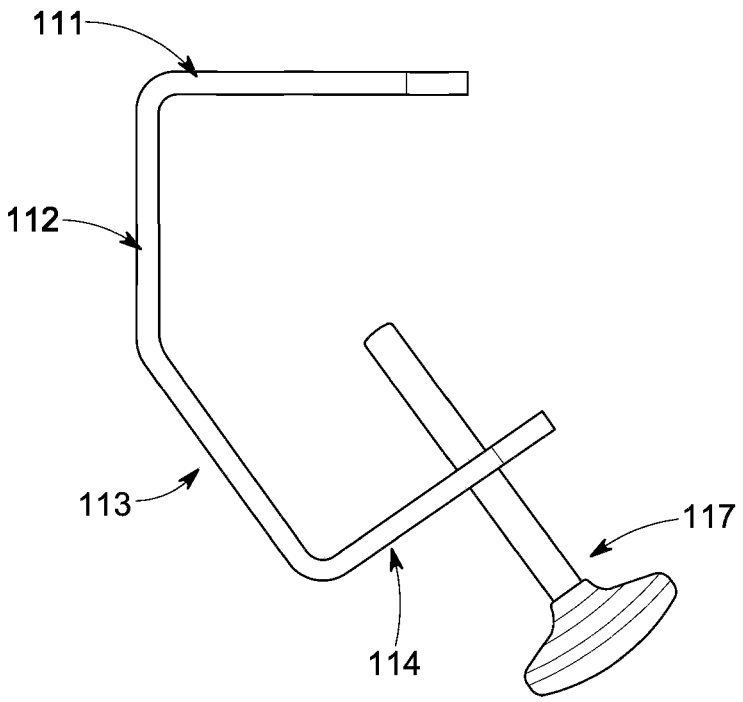
FIGS. 9A and 9B illustrates side and perspective views of the bracket used to secure the exercise unit to a desk according to the embodiments of the present invention.
Figure 9B:
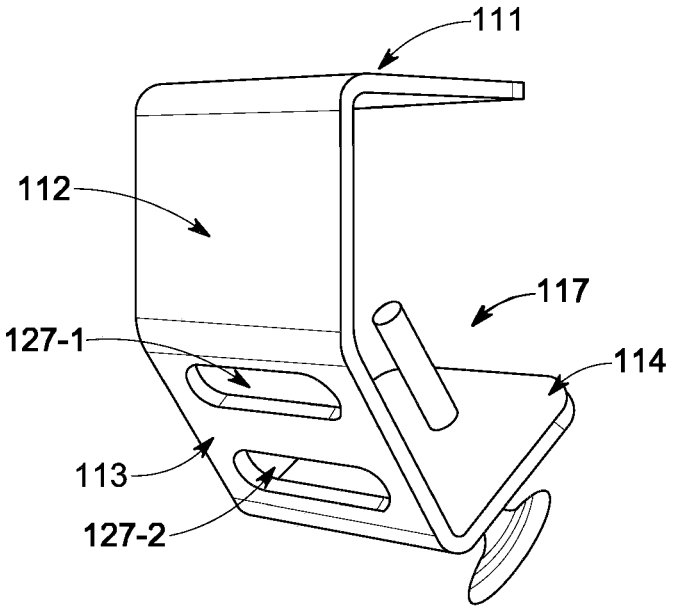

FIGS. 8, 9A and 9B show views of a bracket 110-1 used to attach the exercise unit 100 to a desktop. When attached to a desktop, a flat (or horizontal) top member 111 sits on an upper surface of the desktop while vertical member 112 extends downward along a front edge of the desktop and first angled member 113 extends downward in a direction beneath the desktop and second angled member 114 extends upward at about 90° relative to the first angled member 113. The second angled member 114 includes a threaded aperture 116 for receipt of a threaded connector 117 permitting the bracket 110-1 to be attached securely to the desktop. The first angled member 113 includes cutouts 127-1, 127-2 for attachment of the first set of resistance bands 120-1, 120-2 via clips 140-1, 140-2. An underside of the top member 111 may include a cushion 119, pad or other protective item to prevent damage to an upper surface of the desktop.

Figure 10:
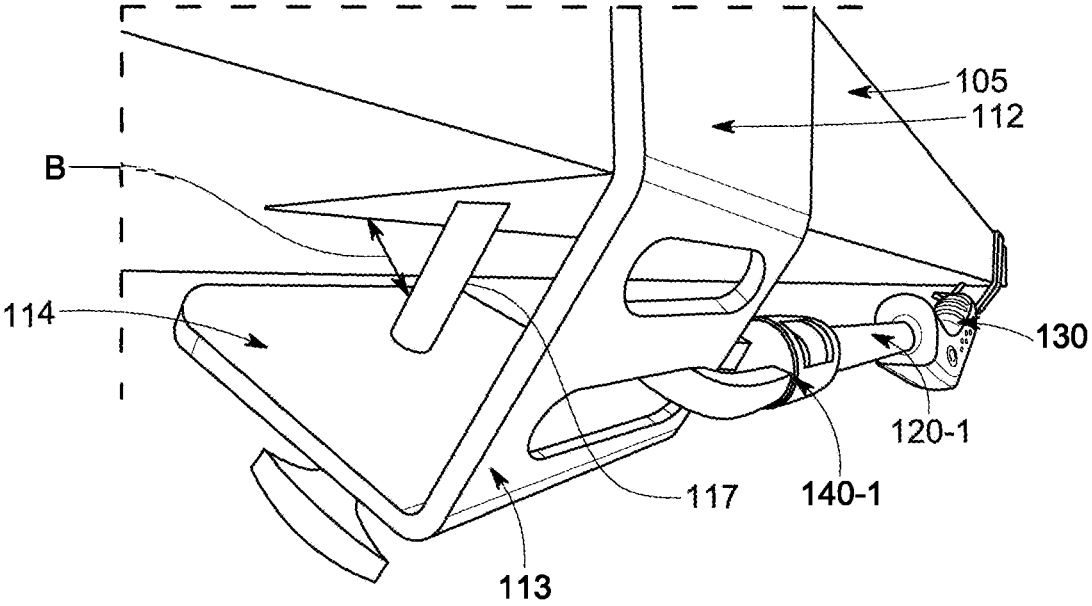
FIG. 10 illustrates the bracket attached to a desktop according to the embodiments of the present invention.

Referring to FIG. 10, the brackets 110-1, 110-2 are designed such that the threaded connector 117, when tightened, contacts the undersurface of the desktop at an acute angle B increasing strength/stability against the force applied to brackets 110-1, 110-2 when the first set of resistance bands 120-1, 120-2 are pulled during use. This arrangement provides greater exercise unit 100 stability than if the threaded connectors 117 contacted the undersurface of the desktop at a substantially vertical or 90° angle.

In practice, a user seated at his or her desk may grip the handle 130 with two hands and pull the first set of resistance bands 120-1, 120-2 from side-to-side, upward and downward (crunches) or in any number of directions to work different muscle groups including the core while increasing heart rate. The exercise unit 100 offers both cardio and core strengthening simultaneously. Using different strength resistance bands and numbers thereof, a user can create a complete workout regime suitable for time at his or her desk.

Figure 14A:
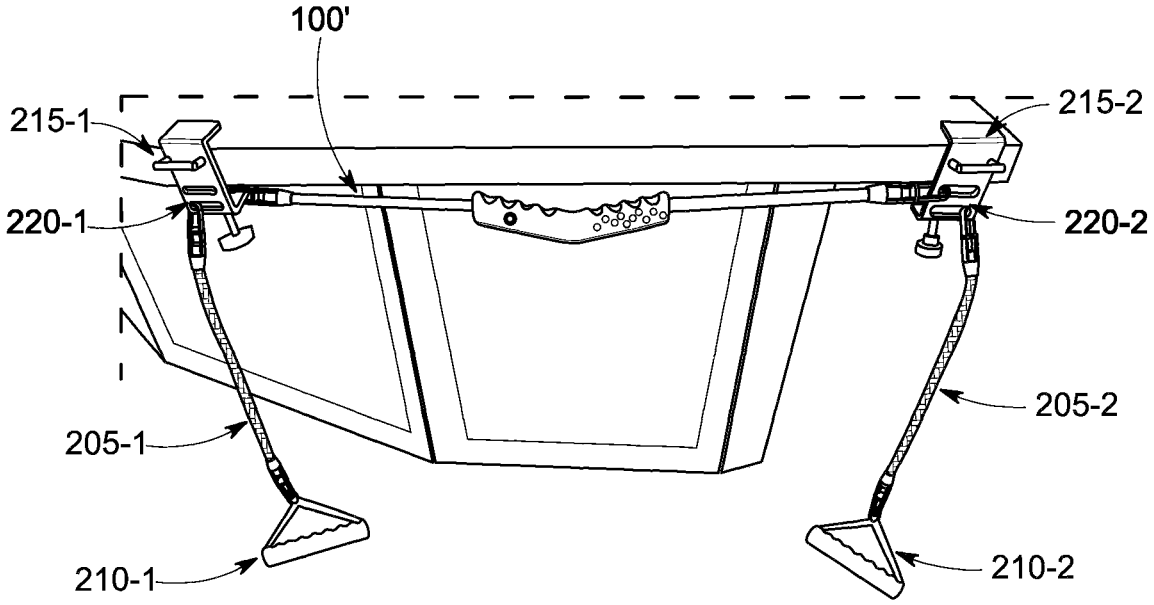
FIG. 14A illustrates the exercise unit with additional resistance bands and handles attached to the brackets according to the embodiments of the present invention.
Figure 14B:
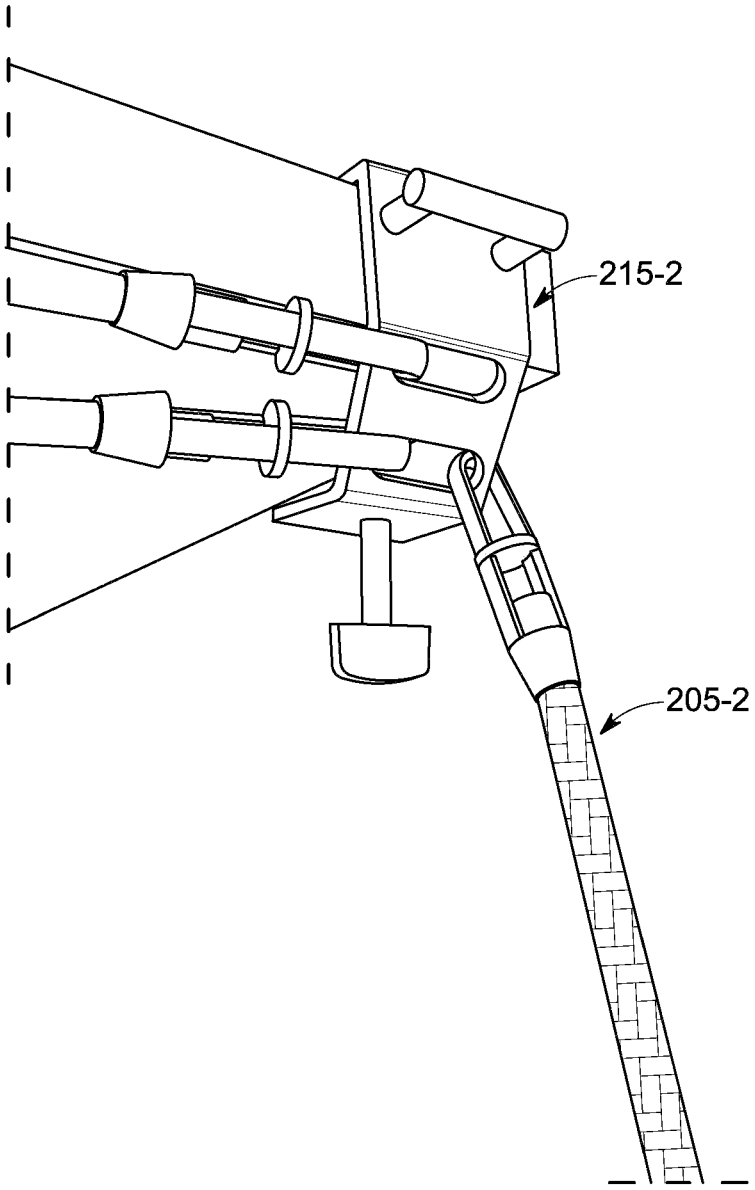
FIG. 14B illustrates a close-up view of an additional resistance bands and corresponding handle attached to a bracket of the exercise unit according to the embodiments of the present invention.
Figure 14C:
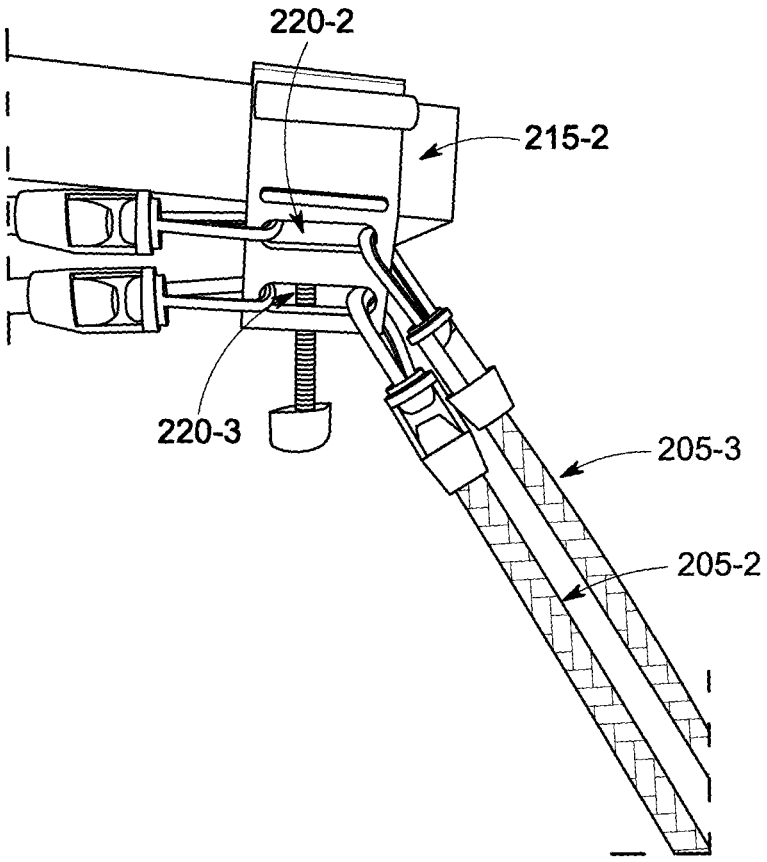
FIG. 14C illustrates a close-up view of two additional resistance bands and corresponding handles attached to a bracket of the exercise unit according to the embodiments of the present invention.

FIG. 14A shows the exercise unit 100' with a second set of resistance bands 205-1, 205-2 and corresponding handles 210-1, 210-2 attached to brackets 215-1, 215-2 via slots 220-1, 220-2 according to the embodiments of the present invention. FIG. 14B shows exercise unit 100' with additional resistance band 205-2. FIG. 14C illustrates a close up of the second set of resistance bands 205-2, 205-3 and corresponding handles (not shown) attached to a single bracket 215-2 of the exercise unit 100' according to the embodiments of the present invention.

Figure 15A:
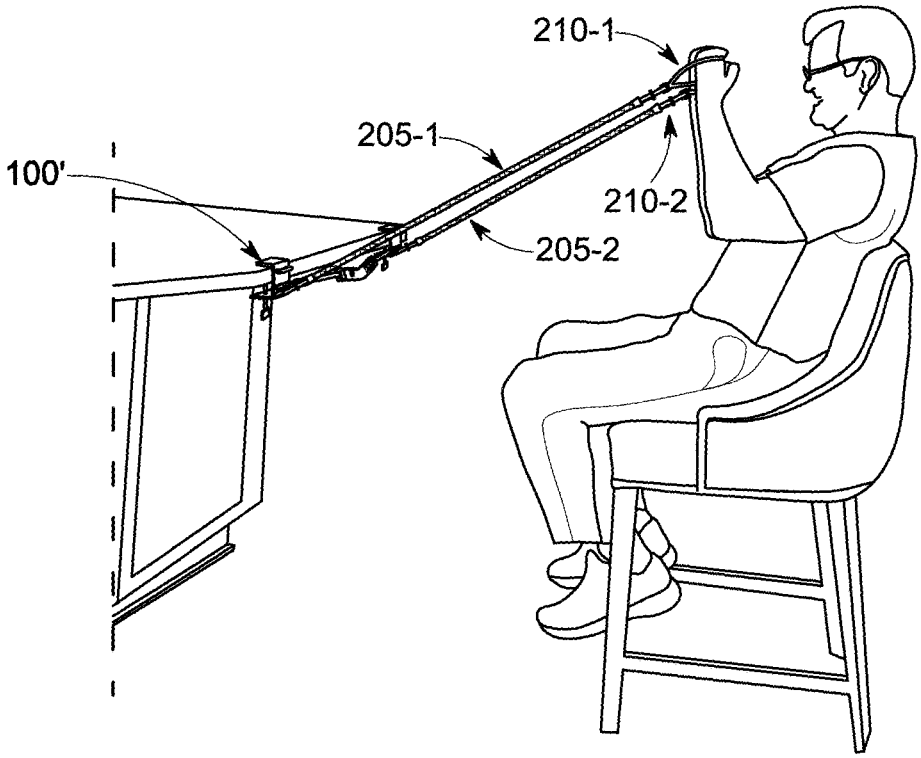
FIG. 15A illustrates the additional resistance bands and handles being used to perform curl exercises according to the embodiments of the present invention.

FIG. 15A shows a user doing curling type exercises using the second set of resistance bands 205-1, 205-2 and handles

Figure 15B:
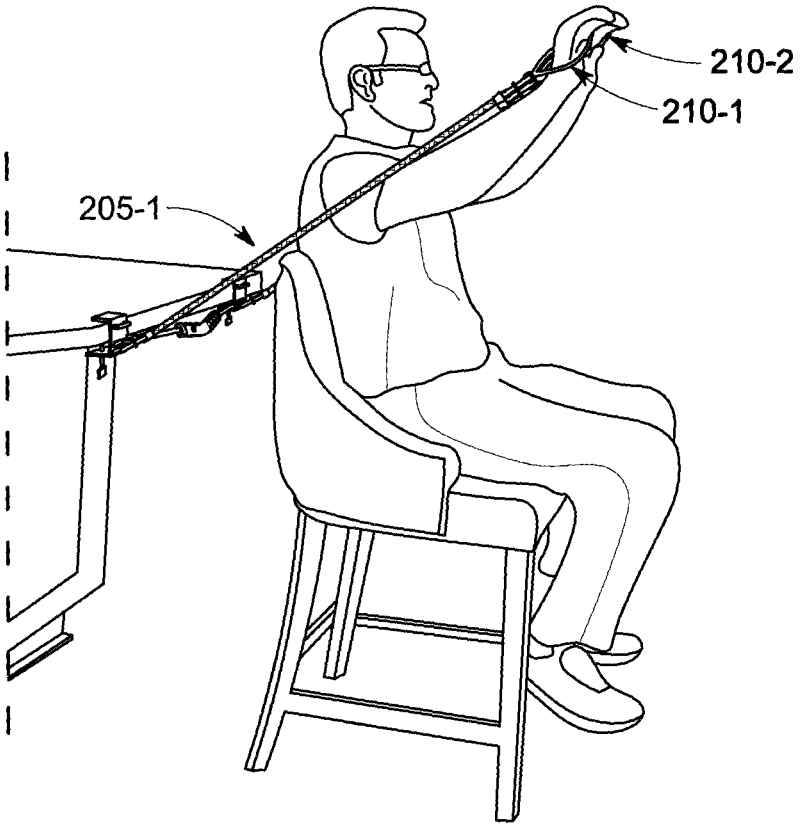
FIG. 15B illustrates the additional resistance bands and handles being used to perform press exercises according to the embodiments of the present invention.
Figure 15C:
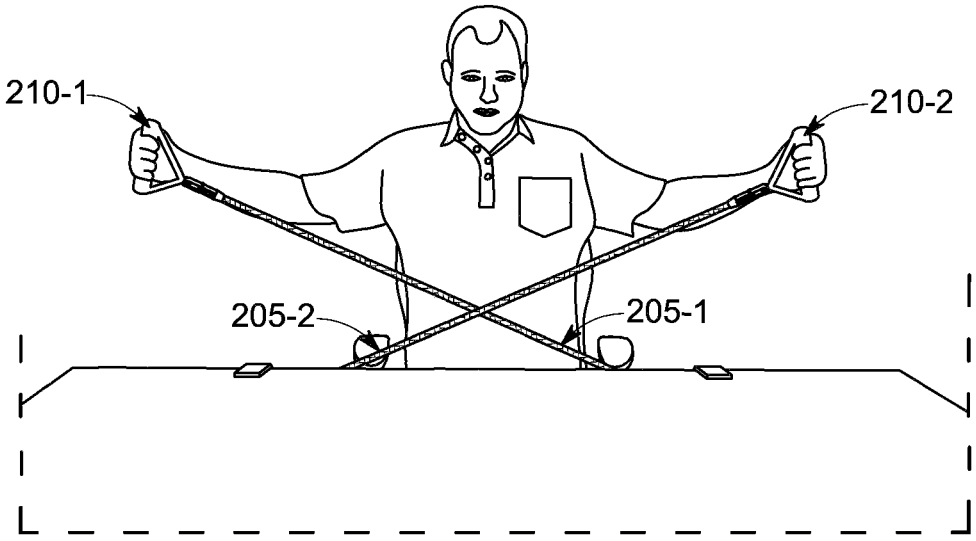
FIG. 15C illustrates the additional resistance bands and handles being used to perform upper back exercises according to the embodiments of the present invention.
Figure 15D:
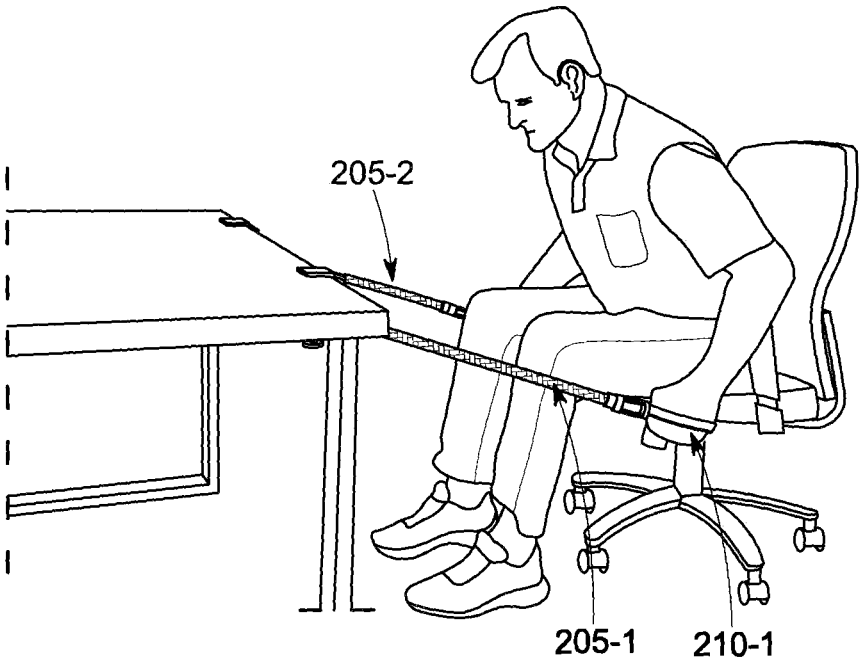
FIG. 15D illustrates the additional resistance bands and handles being used to perform shoulder and triceps exercises according to the embodiments of the present invention.

210-1, 210-2. FIG. 15B shows a user doing press type exercises using the second set of resistance bands 205-1, 205-2 and handles 210-1, 210-2. FIG. 15C shows a user doing upper back type exercises using the second set of resistance bands 205-1, 205-2 and handles 210-1, 210-2. FIG. 15D shows a user doing shoulder and triceps type exercises using the second set of resistance bands 205-1, 205-2 and handles 210-1, 210-2.

Figure 16A:
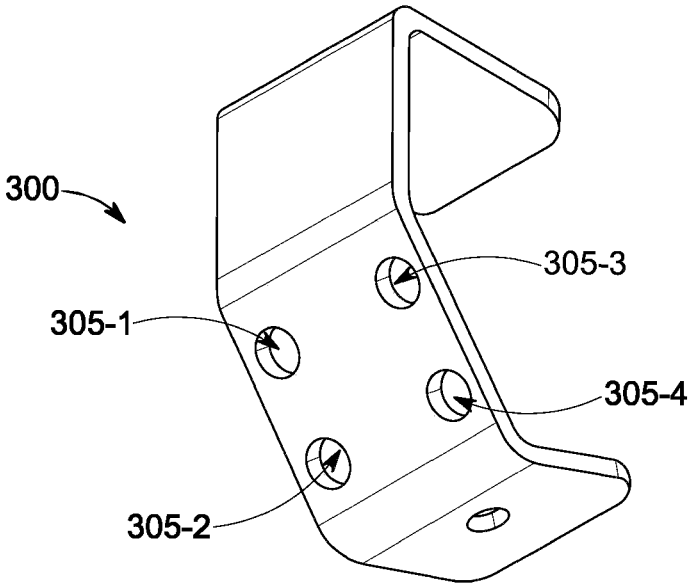
FIG. 16A illustrates an alternative bracket design according to the embodiments of the present invention.

FIG. 16A shows an alternative bracket design 300 according to the embodiments of the present invention. In this embodiment, the bracket 300 includes a plurality of apertures 305-1 through 305-4 configured for attachment of resistance bands. Bracket 300 attaches to a table or desk in the same manner described relative to brackets 110-1, 110-2.

Figure 16B:
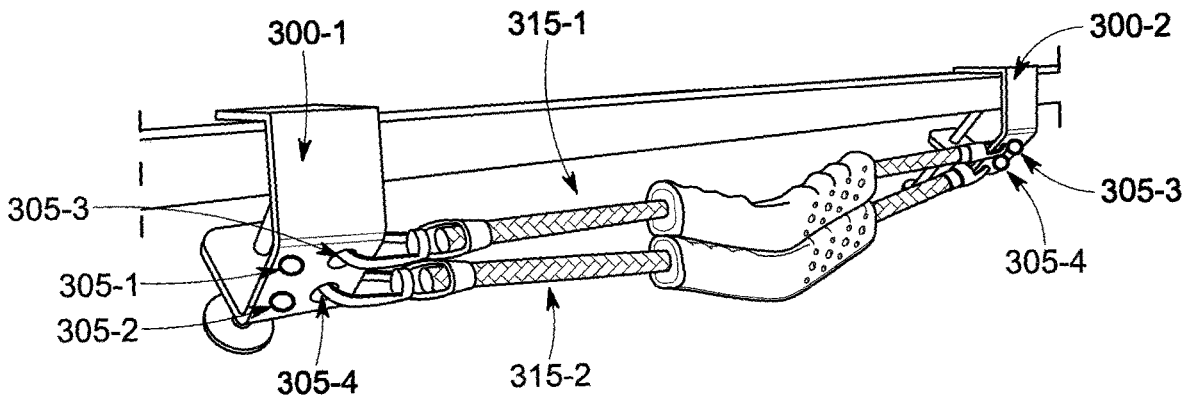
FIG. 16B illustrates the alternative bracket design in practice according to the embodiments of the present invention.
Figure 16C:
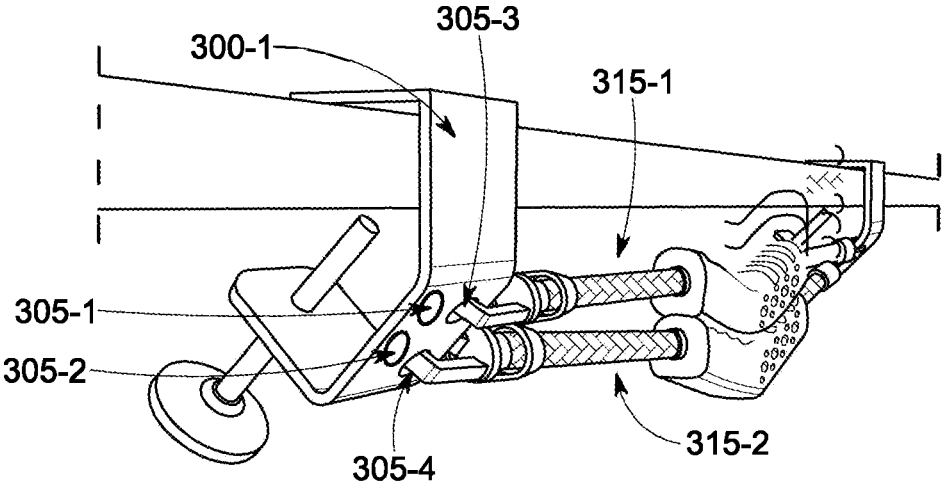
FIG. 16C illustrates the alternative bracket design in practice according to the embodiments of the present invention.

FIGS. 16B and 16C show the alternative bracket design 300 in practice according to the embodiments of the present invention. As shown, apertures 305-3 and 305-4 on bracket 300-1 and apertures 305-1 and 305-2 on bracket 300-2 are used to secure horizontal resistance bands 315-1 and 315-2, respectively. Apertures 305-1 and 305-2 on bracket 300-1 and apertures 305-3 and 305-4 on bracket 300-2 may be used to attach additional resistance bands as shown in FIGS. 14A-14C.

Besides increasing heart rate and exercise muscles, the exercise unit 100 helps people be more productive by keeping them awake and alert and providing more energy. By sitting up straight with shoulders back and strengthening the abdominal muscles, the exercise unit 100 also helps people with neck, shoulder and lower back pain. The exercise device 100 also helps people cope with depression or other negativity by offering short healthy bursts of exercise which has been shown to make people feel good about themselves.

Although the invention has been described in detail with reference to several embodiments, additional variations and modifications exist within the scope and spirit of the invention as described and defined herein.

I claim:

1. An exercise unit comprising:

a pair of brackets, said pair of brackets configured to attach to an article having a top with a substantially flat upper surface and a substantially flat undersurface, wherein each bracket of said pair of brackets each comprise an upper horizontal member, vertical member, first angled member, second angled member and an aperture for passage of an adjustable connector, said adjustable connector for securing the respective bracket of said pair of brackets to said article, each bracket of said pair of brackets configured such that the adjustable connector when fed through said aperture contacts the undersurface of the top at an acute angle, wherein when each bracket of said pair of brackets are attached to said top, said upper horizontal member rests on the upper surface of said top, said vertical member runs along a front edge of said top, said first angled member extends downward beneath said top and said second angled member extends upward towards the undersurface of said top;

a first set of one or more resistance bands, said first set of said one or more resistance bands including an elongate handle, said first set of one or more resistance bands removably attachable to said pair of brackets wherein said pair of brackets are configured such that said first set of one or more resistance bands and said elongate handle are positioned beneath said top when connected to said pair of brackets attached to said article;

a second set of one or more resistance bands, each resistance band of said second set of one or more resistance bands having a handle at a first end thereof and removably attachable at a second end to said pair of brackets; and wherein said first angled member of each said bracket of said pair of brackets includes one or more cutouts, slots or openings for attachment of said first set of one or more resistance bands and said second set of one or more resistance bands.

2. The exercise unit of claim 1 wherein said article is a desk, table or countertop.

3. The exercise unit of claim 1 wherein each resistance band of said first set of one or more resistance bands is connected at one end to the elongate handle and further connects to a respective clip at an end opposite to connection with said elongate handle.

4. The exercise unit of claim 1 wherein each resistance band of said first set of one or more resistance bands is connected at one end to the elongate handle and includes sleeves at the one end connected to said elongate handle.

5. The exercise unit of claim 1 wherein said second angled member of each said bracket of said pair of brackets includes an aperture for passage of said respective adjustable connector.

* * * * *